US006763798B2

(12) United States Patent
Möller et al.

(10) Patent No.: US 6,763,798 B2
(45) Date of Patent: Jul. 20, 2004

(54) AUXILIARY DRIVE FOR INTERNAL COMBUSTION ENGINES

(75) Inventors: Heribert Möller, Sachsen (DE); Josef Winter, Rednitzhembach (DE)

(73) Assignee: MAN Nutzfahrzeuge AG (DE)

( * ) Notice: Subject to any disclaimer, the term of this patent is extended or adjusted under 35 U.S.C. 154(b) by 0 days.

(21) Appl. No.: 10/083,708

(22) Filed: Jul. 20, 2001

(65) Prior Publication Data

US 2003/0145822 A9 Aug. 7, 2003

(30) Foreign Application Priority Data

Jul. 21, 2000 (DE) ..... 100 35 546

(51) Int. Cl.[7] ..... F02B 77/00
(52) U.S. Cl. ..... 123/198 R; 123/195 A
(58) Field of Search ..... 123/198 R, 198 L, 123/195 A

(56) References Cited

U.S. PATENT DOCUMENTS 3,073,291 A * 1/1963 Leonard et al. ..... 123/195 A
3,421,490 A * 1/1969 Wiseman ..... 123/195 R

* cited by examiner

*Primary Examiner*—Noah P. Kamen
(74) *Attorney, Agent, or Firm*—R W Becker & Associates; R W Becker

(57) ABSTRACT

An auxiliary drive is provided for an internal combustion engine and includes a shaft supported in a housing by means of radial and axial bearings and a gear having the shaft non-rotatably secured thereto. The gear is driveable by a crankshaft of the internal combustion engine via intermediary gearing. The auxiliary drive also includes a power take off flange non-rotatably secured to a free end of the shaft for transferring power to a working engine such as, for example, a cement mixer. The shaft with the radial and axial bearings and the gear are integrated into the crankcase of the internal combustion engine and the gear is located directly between the radial bearings.

6 Claims, 3 Drawing Sheets

AUXILIARY DRIVE FOR INTERNAL COMBUSTION ENGINES

BACKGROUND OF THE INVENTION

The present invention relates to an auxiliary drive for internal combustion engines.

Internal combustion engines for commercial vehicles frequently include an auxiliary drive which serves as the drive for devices such as cement mixers. For this purpose, it is known that one can drive the shaft of an auxiliary drive with a crankshaft of the internal combustion engine via intermediate gears. The auxiliary drive, which is substantially comprised of a shaft having gears thereon, the radial and axial bearings, and the power takeoff flange, is housed or integrated in a separate housing which is flanged to the crankcase housing of the internal combustion engine. The gear of the auxiliary drive is, in this event, freely movably supported in the bearings. A configuration of this type requires additional installation space next to the crankcase which, with respect to commercial vehicles, is, in any event, very tight. The housing of the auxiliary drive leads additionally to additional costs. The configuration of the freely movable bearing support of the gear causes, via the unavoidable play at the free end of the shaft, impact-producing movement and thus produces, via the gear, unpleasant operational noise.

SUMMARY OF THE INVENTION

The present invention offers a solution to the challenge of configuring an auxiliary drive such that no additional room is needed adjacent the crankcase and the operational noise is effectively suppressed.

The complete integration of the auxiliary drive in the crankcase requires no additional room. Due to the location of the radial bearing directly adjacent the gear, the impact-producing movement of the shaft, which occurs in connection with freely movable bearings, is suppressed and the operational noise is effectively reduced.

Due to the tapered or graduated shaft and the configuration of the bearing, mounting of the complete auxiliary drive into the crankcase can be effected in a very good manner from the outside.

The present invention also encompasses additional advantageous configurations of the axial bearing and the lubrication of the bearing.

BRIEF DESCRIPTION OF THE DRAWINGS

An exemplary embodiment of the auxiliary drive of the present invention, as well as a conventional auxiliary drive representative of the state of the art, is described with respect to the figures of the drawings, in which.

DETAILED DESCRIPTION OF PREFERRED EMBODIMENTS

Figure 1:
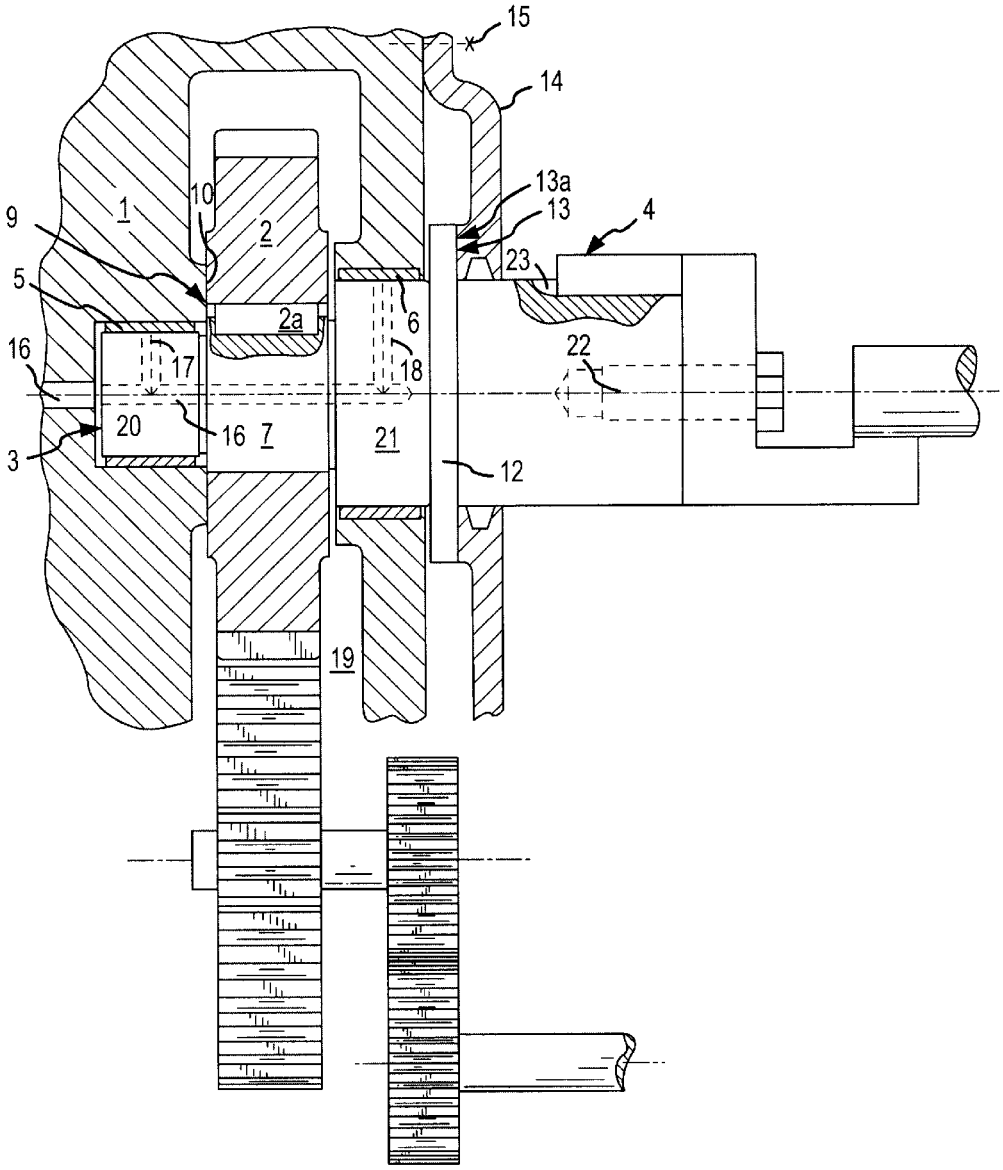
FIG. 1 is a longitudinal view of the auxiliary drive completely integrated in the crankcase of the internal combustion engine.

The integration of an auxiliary drive in accordance with the present invention into a crankcase 1 of an internal combustion engine is shown in a longitudinal view in FIG. 1. The auxiliary drive, as it is configured, for example, for use in commercial vehicles for the driving of cement mixers, essentially comprises a gear 2, a shaft 3, and a power takeoff flange 4. The gear 2 is disposed in bearings directly between the first and second radial bearings 5, 6 in the crankcase 1 and is secured against rotation i.e., is non-rotatably connected to a shaft collar 7 of the shaft 3.

The securement of the gear 2 against rotation relative to the shaft 3 can be effected through a shaft spring 2*a*.

In contrast to a freely movable bearing support, as is the case in the state of the art (FIG. 3), a very precise guiding of the gear 2 is achieved with the auxiliary drive of the present invention and, thus, a high degree of low operational noise.

The axial guiding of the gear 2 and the shaft 3 is accomplished, on the one hand, via a first axial bearing 9 cooperating with a counter rotation surface 10 on the rear side of a hub of the gear 2. On the other hand, a shaft cutout 12 on the shaft 3 assumes the function of a second axial bearing 13. The shaft cutout 12 operates cooperatively with a running surface 13*a* which is arranged on a housing flange 14. The housing flange 14 is secured via bolts 15 to the crankcase 1.

Bores 16, 17, 18 are provided for lubricating the bearings and the gear 2, the bores communicating with a circulating forced lubricating system of the internal combustion engine. The communication to the circulating forced lubricating system can be effected through the central bore 16.

In connection with the mounting of the auxiliary drive, initially the gear 2 is inserted into a recess 19 in the crankcase 1. Thereafter, the shaft 3 is installed. The shaft is provided with a tapered or graduated diameter for effecting this installation.

The first shaft collar 20, which cooperates with the radial bearing 5, has the smallest diameter. The shaft collar 7, which is configured for receipt of the gear has a diameter somewhat greater than the diameter of the first shaft collar 20. The second shaft collar 21 has the greatest relative diameter, this shaft collar cooperating with the radial bearing 6.

Following the installation of the gear 2 and the shaft 3, the housing flange 14 is secured via bolts 15 to the crankcase 1. The running surface 13*a* should exhibit a relatively small axial play relative to the shaft cutout 12 following the securement of the housing flange 14 to the crankcase 1.

Finally, the power takeoff flange 4 is secured via a central bolt 22 to the shaft 3. The torque transfer from the shaft 3 to the power takeoff flange is effected via a splined shaft connector 23.

Figure 2:
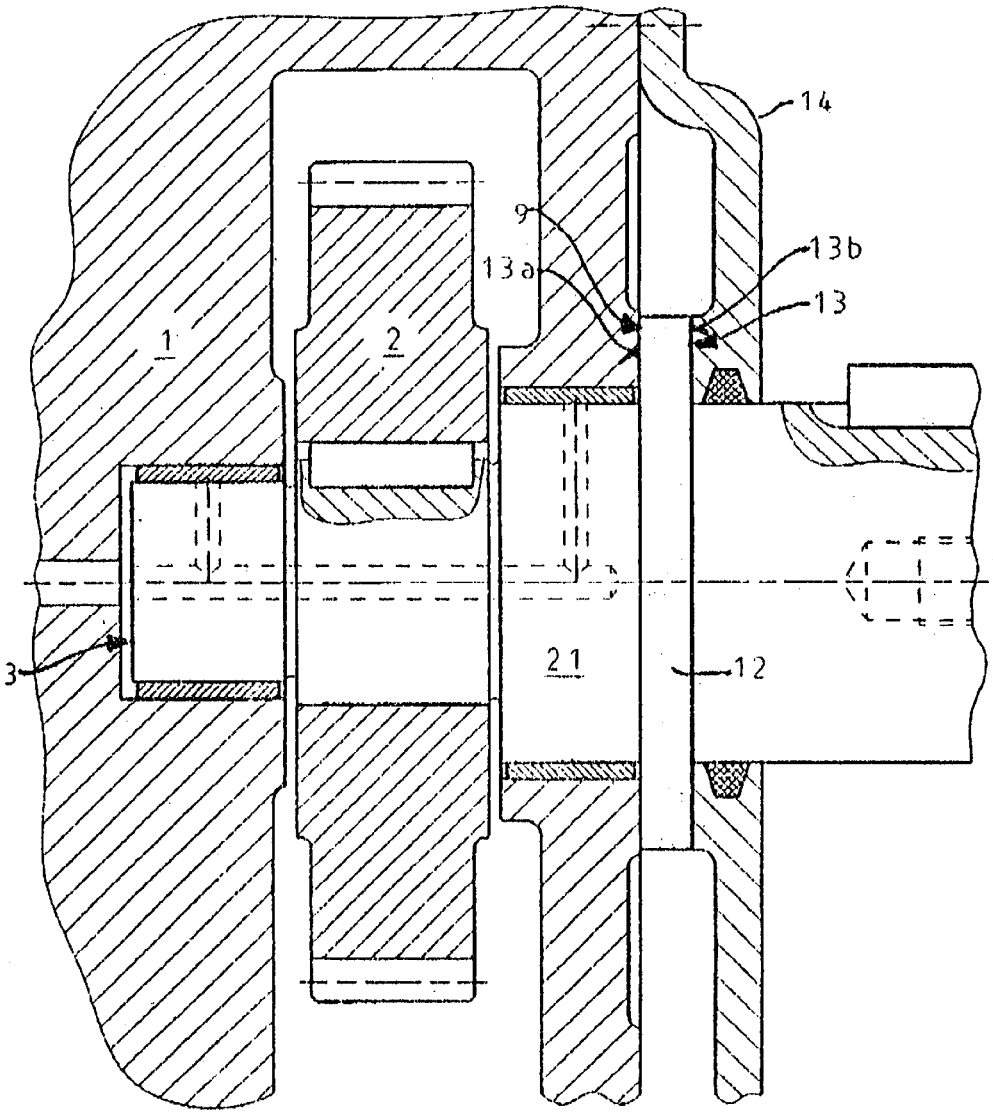
FIG. 2 is a longitudinal view through the auxiliary drive with the axial guiding along a shaft recess.

FIG. 2 shows an alternate embodiment of the axial bearing disposition of the shaft 3. The shaft cutout 12 fulfills the function of the first and second axial bearings 9, 13. The shaft cutout 12 is, in this connection, extended between two running surfaces 13*a* and 13*b*, whereby the running surface 13*a* is associated with the crankcase 1 and the running surface 13*b* is associated with the housing flange 14. The gear 2 can, thus, in the region of the hub, have some play relative to the crankcase 1 and to the shaft cutout 12.

Figure 3:
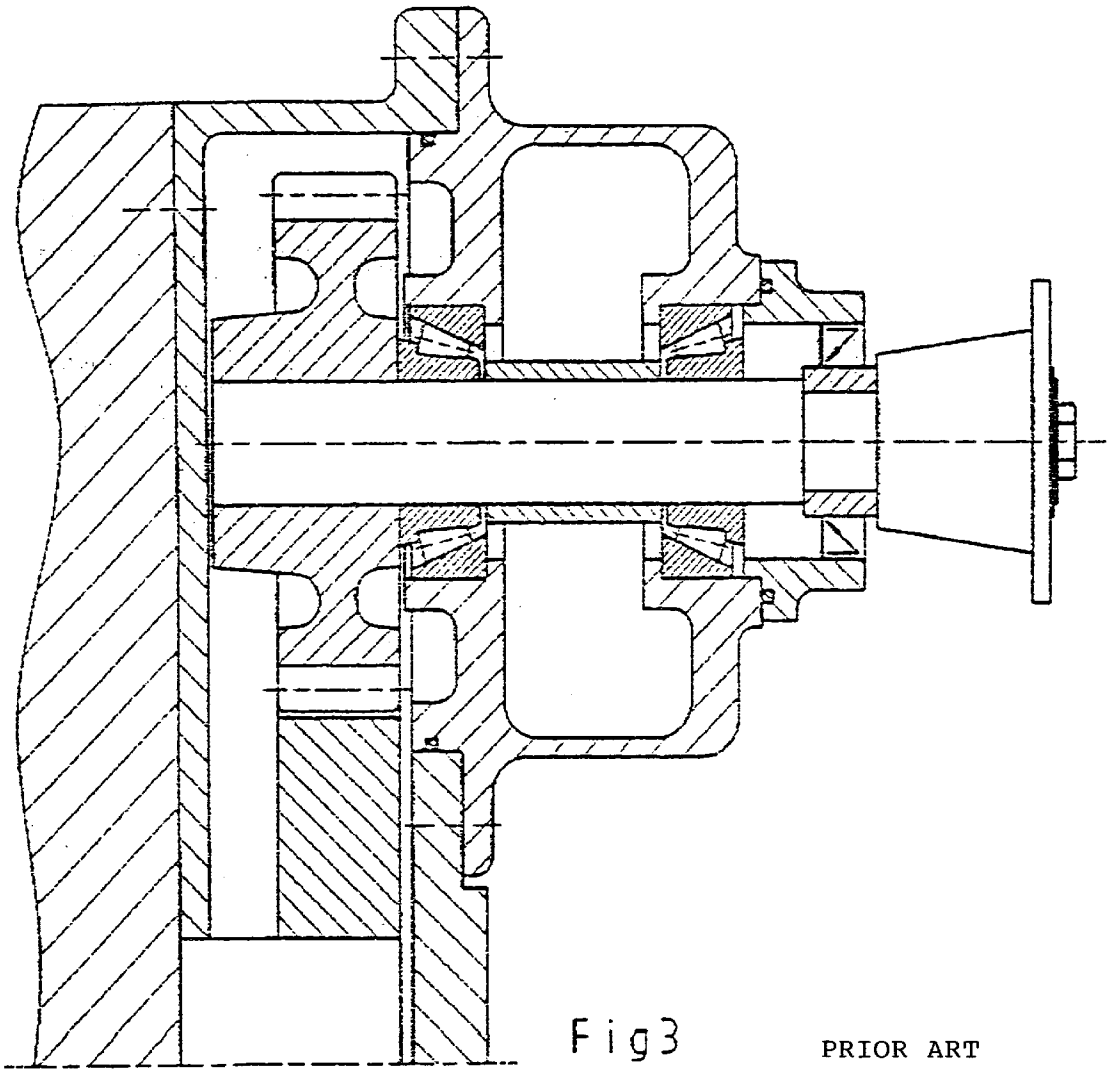
Fig3 PRIOR ART
FIG. 3 is a longitudinal view of a conventional auxiliary drive representative of the state of the art.

FIG. 3 shows a conventional auxiliary drive which is freely movably disposed in bearings in a separate housing. The housing is flanged to the coupling side rear surface of the crankcase. Due to the freely moving bearing disposition of the auxiliary drive, only an incomplete centering of the gear is achieved. The result is disturbing operational noise.

Additionally, an auxiliary drive of such a configuration requires additional installation space which precisely in connection with installation in commercial vehicles is only available to a limited extent. Since a connection to the circulating force lubricating system is not possible, roller bearings are required which are more expensive and more voluminous than sliding bearings.

The specification incorporates by reference the disclosure of German priority document 100 35 546.3 filed Jul. 21, 2000.

The present invention is, of course, in no way restricted to the specific disclosure of the specification and drawings, but also encompasses any modifications within the scope of the appended claims.

We claim:

1. An auxiliary drive for an internal combustion engine, the internal combustion engine having a crankshaft and a crankcase, the auxiliary drive comprising:

a shaft supported in a housing by means of radial and axial bearings;

a gear non-rotatably secured to said shaft, the gear being driveable by a crankshaft of the internal combustion engine via intermediary gearing; and a power take off flange non-rotatably secured to a free end of the shaft for transferring power to an auxiliary driven device, the shaft with the radial and axial bearings and the gear being integrated into the crankcase of the internal combustion engine and the gear being located directly between the radial bearings.

2. An auxiliary drive according to claim 1, wherein the shaft has a tapering diameter for facilitating mounting of the shaft into the crankcase in a configuration in which a first shaft collar cooperating with the first radial bearing has the smallest diameter, a shaft collar configured for receipt of the gear has a diameter somewhat greater than the diameter of the first shaft collar and a second shaft collar cooperating with the second radial bearing has the greatest relative diameter.

3. An auxiliary drive according to claim 1, wherein a first axial bearing is associated with the crankcase and cooperates with a counter rotation surface on a rear side of a hub of the gear, and a second axial bearing is configured as a shaft cutout which cooperates with a running surface which is arranged on a housing flange.

4. An auxiliary drive according to claim 2, wherein the first and second axial bearings are associated with a shaft cutout, whereby a first running surface is associated with a housing flange and a second running surface is associated with the crankcase, and the gear in a hub area thereof can be configured with some play relative to the crankcase and the second shaft collar.

5. An auxiliary drive according to claim 1, wherein lubrication of the radial and axial bearings and the gear is effected via bores which are located in the shaft, wherein a central bore communicates with a circulating forced lubricating system of the internal combustion engine.

6. An auxiliary drive according to claim 1, wherein the auxiliary driven device is a cement mixer.

* * * * *